United States Patent [19]

Avesani et al.

[11] 4,307,676

[45] Dec. 29, 1981

[54] MULTILAYER WORKPIECE GUIDING DEVICE FOR SEWING MACHINES

[75] Inventors: Luigi Avesani, Bollate; Roberto Sanvito, Milan, both of Italy

[73] Assignee: Rockwell-Rimoldi, S.p.A., Milan, Italy

[21] Appl. No.: 952,506

[22] Filed: Oct. 18, 1978

[30] Foreign Application Priority Data

Nov. 8, 1977 [IT] Italy ..... 29418 A/77

[51] Int. Cl.[3] ..... D05B 35/10; D05B 21/00

[52] U.S. Cl. ..... 112/153; 112/306

[58] Field of Search ..... 112/153, 136, 141, 142, 112/143, 51, 306; 226/15, 19, 3

[56] References Cited

U.S. PATENT DOCUMENTS

| | | | |
|---|---|---|---|
| 3,814,039 | 6/1974 | Heiler et al. | 112/153 |
| 3,875,881 | 4/1975 | Marforio | 112/153 |
| 4,075,957 | 2/1978 | Marforio | 112/153 |
| 4,086,860 | 5/1978 | Kosrow et al. | 112/153 |
| 4,102,281 | 7/1978 | Collbrunn et al. | 112/153 X |
| 4,126,097 | 11/1978 | Willenbacher | 112/153 |
| 4,159,687 | 7/1979 | Masuda et al. | 112/306 |

FOREIGN PATENT DOCUMENTS

| | | | |
|---|---|---|---|
| 476869 | 11/1975 | U.S.S.R. | 112/153 |

*Primary Examiner*—Werner H. Schroeder

[57] ABSTRACT

A device for simultaneously guiding at least two layers of fabric to the stitching instrumentalities of a sewing machine in which a portion of one layer has a greater width than that of the other. The device includes superposed passages with a limiting element within each passage for separately engaging and guiding the edges of the layers of fabric. One of the limiting elements is fixedly held within its respective passage and the other is movable. The movable limiting element serves to align that portion of the layer of wider width with the edge of the adjacent layer prior to joining the layers by an assembly seam.

7 Claims, 8 Drawing Figures

MULTILAYER WORKPIECE GUIDING DEVICE FOR SEWING MACHINES

BACKGROUND OF THE INVENTION

The present invention pertains to a device for guiding a workpiece in a sewing machine which includes two superposed passages in each of which a layer of fabric is adapted to travel. These passages serve to align the edges of the two layers of fabric prior to joining said edges by means of an assembly seam.

In known guiding devices of the above mentioned type the superposed passages are commonly formed by horizontal laminae between which a limiting element is inserted. The height of the limiting element corresponds to the thickness of each layer to be assembled and the guiding surface thereof is located at a predetermined distance within the passage so as to control the distance of the assembly seam from the edges being joined.

Each limiting element within its respective passage is generally formed by a small block of desired shape or can be formed by a series of pegs which extend through the laminae and whose successive arrangement forms the above mentioned guiding surface.

The distance of the guiding surface or so-called vertical wall of the limiting element from the axis of stitching can be varied at the assembly stage in order to control the distance at which the seam must be formed from the edge of the layers of fabric. Once this distance has been fixed, it remains unchanged during the stitching operation.

Known guiding devices have been found to be completely inadequate in automatic stitching operations when it is necessary to align layers having portions thereof of different widths while joining them by means of an assembly seam.

The problem is particularly felt where it is necessary to provide, for exammple, an inner assembly seam on the leg portions of trousers wherein a portion of one layer of the workpiece is of greater width than the other and which must be brought into alignment, one with the other. The alignment and joining of layers of fabric in the manner described above serves to provide a configuration to the article of clothing being formed which corresponds to the actual shape of the body of the person who will wear said article.

An object of the invention is to provide a guiding device for a workpiece which is capable of displacing the edge of at least one of the layers of fabric with respect to the other during the formation of the seam so that the seam will not be parallel to said displaced edge.

SUMMARY OF THE INVENTION

The guiding device of the present invention if formed by two superposed passages which serve to align, relative to the stitching axis, the layers of fabric as are to be joined by an assembly seam. The device includes in at least one of the passages a limiting element which is movable relative to the stitching axis. An operating means is provided for the movable limiting element which is adapted to vary its initial location with respect to the fixed limiting element in the other passage and for varying its distance from the stitching axis during the formation of a seam.

Additional objects of the invention will become more fully apparent by reference to the appended claims and as the following detailed description proceeds in reference to the figures of the drawings wherein:

FIG. 1 is a top view of the guiding device according to the invention;

FIG. 1*a* is a perspective view of the device in FIG. 1 showing its relationship to the stitching instrumentalities;

FIG. 2 is a sectional view of the device taken along line II—II of FIG. 1;

FIG. 2*a* is a view similar to FIG. 1*a* and partially in section with certain elements omitted to show further detail of the limiting elements slidably mounted therein;

DESCRIPTION OF THE PREFERRED EMBODIMENT

Figure 1:
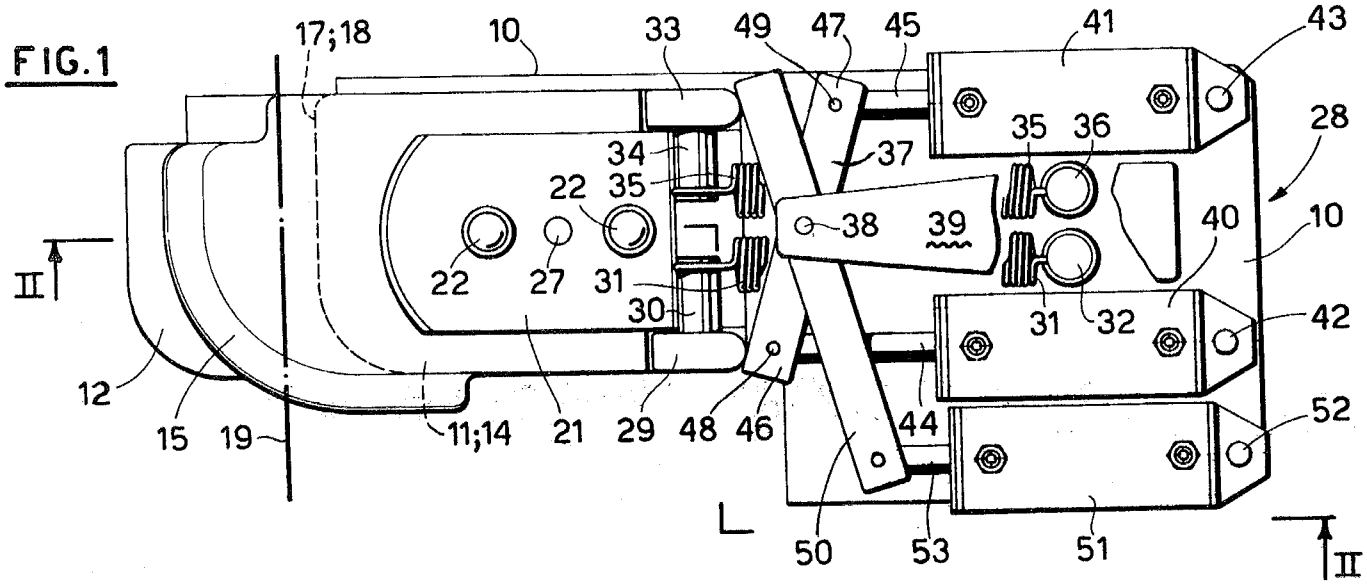
Figure 2:
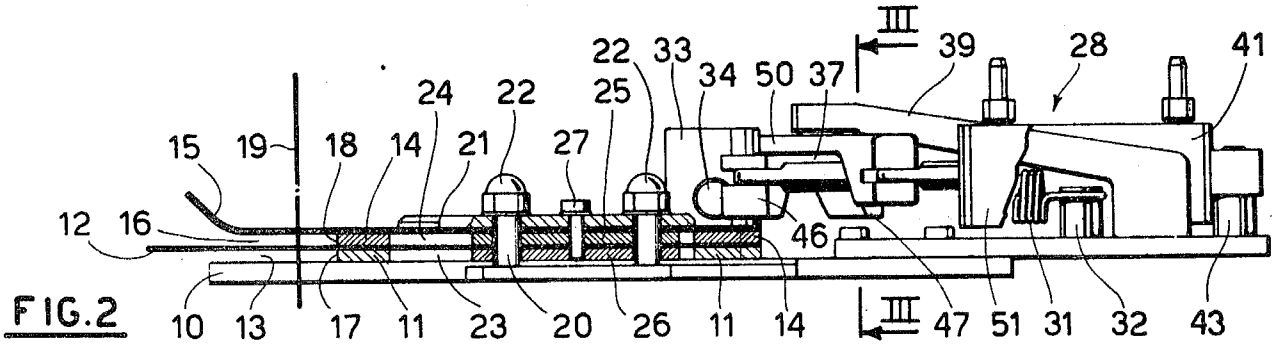
Figures 1A, 2A:
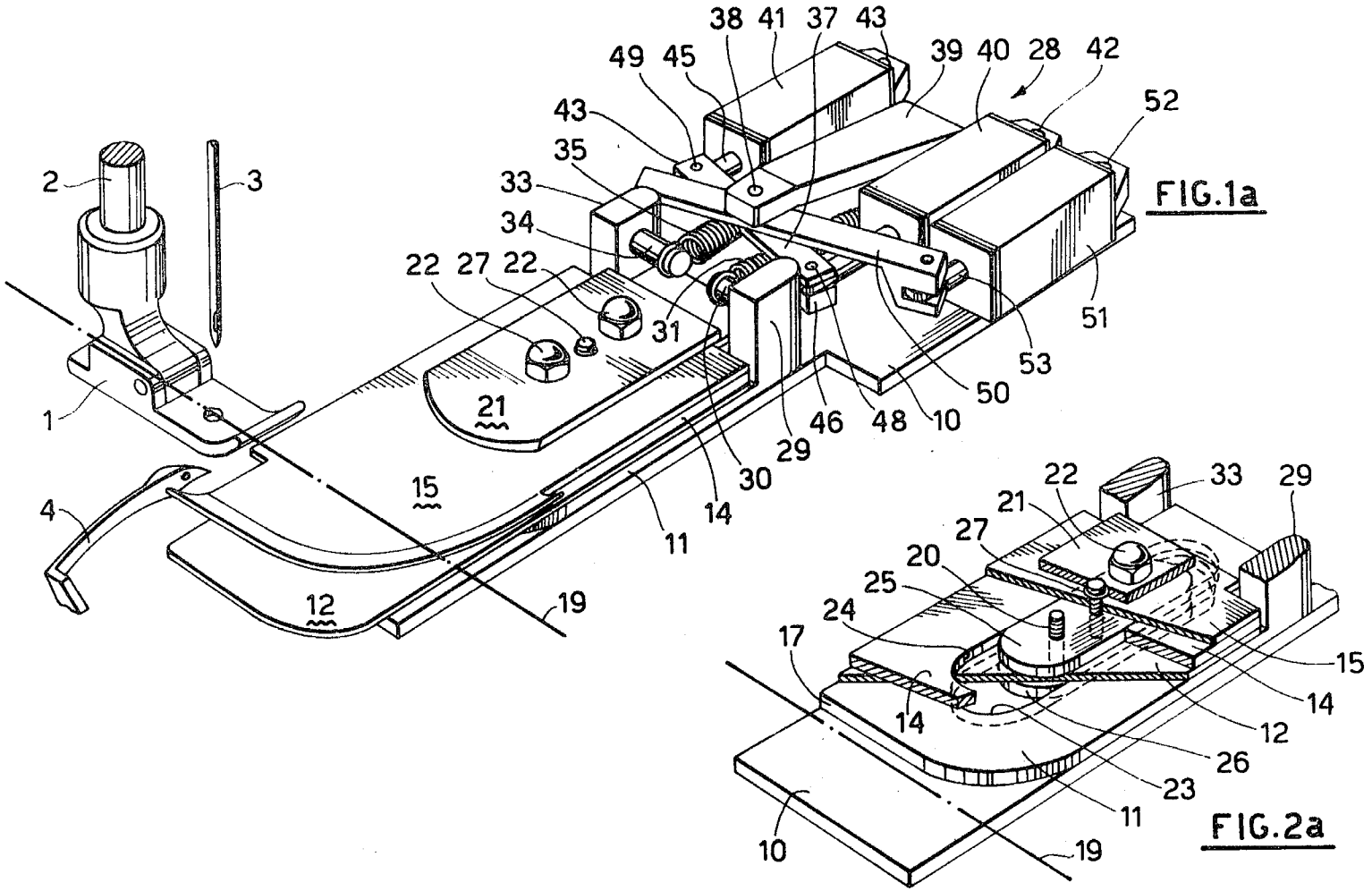
Figure 3:
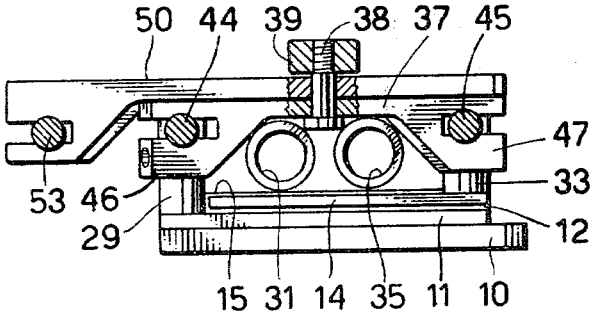
FIG. 3 is a view in front elevation and partially in section taken along the line III—III in FIG. 2.

With reference to FIGS. 1, 2 and 3, the device for guiding a workpiece comprising the present invention is applicable to sewing machines which are suitable for joining two layers of fabric having a configuration for forming a garment such as trousers. These sewing machines as shown in FIG. 1*a* are provided with conventional stitching instrumentalities which include a presser foot 1, presser bar 2, needle 3 and a looper that is identified by numeral 4. This guiding device includes among its various parts a base plate 10 on which a first limiting element 11 is mounted. A horizontally disposed lamina 12 is located in close proximity with this limiting element and extends beyond it to form a passage 13 through which the lower layer of the fabric is adapted to slide.

A second limiting element 14 is located on the intermediate lamina 12 and carries an upper horizontal lamina 15 which, like the intermediate lamina, extends beyond said limiting element 14 and forms a passage 16 for the upper layer of fabric that is to be joined to the lower one.

Each of the limiting elements 11 and 14 includes a vertical wall identified by numerals 17 and 18 respectively which are identically shaped and whose height corresponds substantially to the thickness of the fabric they are adapted to guide. The distance of these walls 17 and 18 from the stitching axis 19 corresponds to the distance between the seam to be formed and the corresponding edge of the fabric layers.

The positioning of the limiting elements 11 and 14 and of the laminae 12 and 15 on the base plate is provided by a pair of vertically extending threaded posts 20 which are fixed to said base plate and extend through openings provided in an upper cover plate 21. A nut 22 assembled on the threaded end of each post provides for the operative association of the various elements of the structure. The passages 13 and 16 are disposed so as to be superposed and separated one from the other in order to independently guide the layers of fabric as they are simultaneously advanced toward the stitching instrumentalities of the sewing machine.

In particular, the guiding device according to the invention provides a means for guiding at least two layers of fabric in which a portion of one layer is of greater width than that of the other layer.

This manner of guiding the fabric layers is particularly required in order that the garment formed thereby will be more adaptable to the shape of the human body.

Depending on the requirements of the garment, the layer of fabric which is wider may be the upper one or the lower one. In either case, the excess portion or "fabric richness" of the wider layer will gradually be reduced during the stitching operation until it no longer exists at a desired point from the start of the stitching where the edges of the two superposed layers come to a position where they are mutually aligned. In order to obtain this the limiting elements 11 and 14 are mounted so as to be slidably displaceable in their respective channels 13 and 16 and, as will be explained below, the slidable element which is adapted to be gradually displaced corresponds to the layer of fabric of greater width, while the other will have its distance from the stitching axis 19 maintained in an unchanged state.

In order to be able to slide within their respective channels, the limiting elements 11 and 14 are each provided with a slot identified by numerals 23 and 24 respectively which extend perpendicularly to the stitching axis 19. Within each of these slots 23 and 24 a spacer is provided and they are identified in FIG. 2 by numerals 25 and 26 respectively and in addition to maintaining compactness of the device they facilitate linearity of the movement of the limiting elements.

A suitable peg 27 which is fixed to the upper cover plate 21 serves to prevent the spacers from moving. In order to be displaced individually in the required manner, the limiting elements 11 and 14 are operatively connected to an operating means 28, which is of the pneumatic type using a one-way connection.

This connection includes among its various parts a vertical striker 29 which is fixed to the first limiting element 11 and which is provided with a horizontal peg 30 having one end of a return spring 31 attached thereto and the opposite end of said spring attached to a peg 32 that is mounted on the base plate 10.

A similar vertical striker 33 is attached to the second limiting element 14 and also includes a horizontal peg identified by numeral 34 having one end of a return spring 35 attached thereto and with said spring's opposite end attached to a peg 36 which is mounted on the base plate 10 in juxtaposed relation with peg 32.

The various elements of the operating means 28 include a positioning means that defines a rocking arm 37 which pivots on a fulcrum 38 carried by a projecting arm 39 that is fixedly mounted on the base plate 10.

This rocking arm is provided to displace one or the other of the strikers so as to displace the limiting elements 11 and 14 that are disposed within the passages in opposition to the action of their associated return springs.

The operating means for the positioning means consists of a pair of oleodynamic cylinders 40 and 41 which pivot on vertical fulcrums 42 and 43 that are mounted on the base plate 10. The actuating rods 44 and 45 of the pistons within the cylinders are pivotably connected to ends 46 and 47 respectively of the rocking arm 37 by means of pivot pins 48 and 49. These ends 46 and 47 are sufficiently displaced from the fulcrum 38 so as to operatively engage their associated strikers 29 and 33.

A selecting means formed by a rocking lever 50 is pivoted coaxially with the first rocking lever 37 on the fulcrum 38. This rocking lever 50 can alternatively come into contact with one or the other of the vertical strikers and serves as a means for selecting the limiting element that is to be displaced during the stitching operation.

Figure 4:
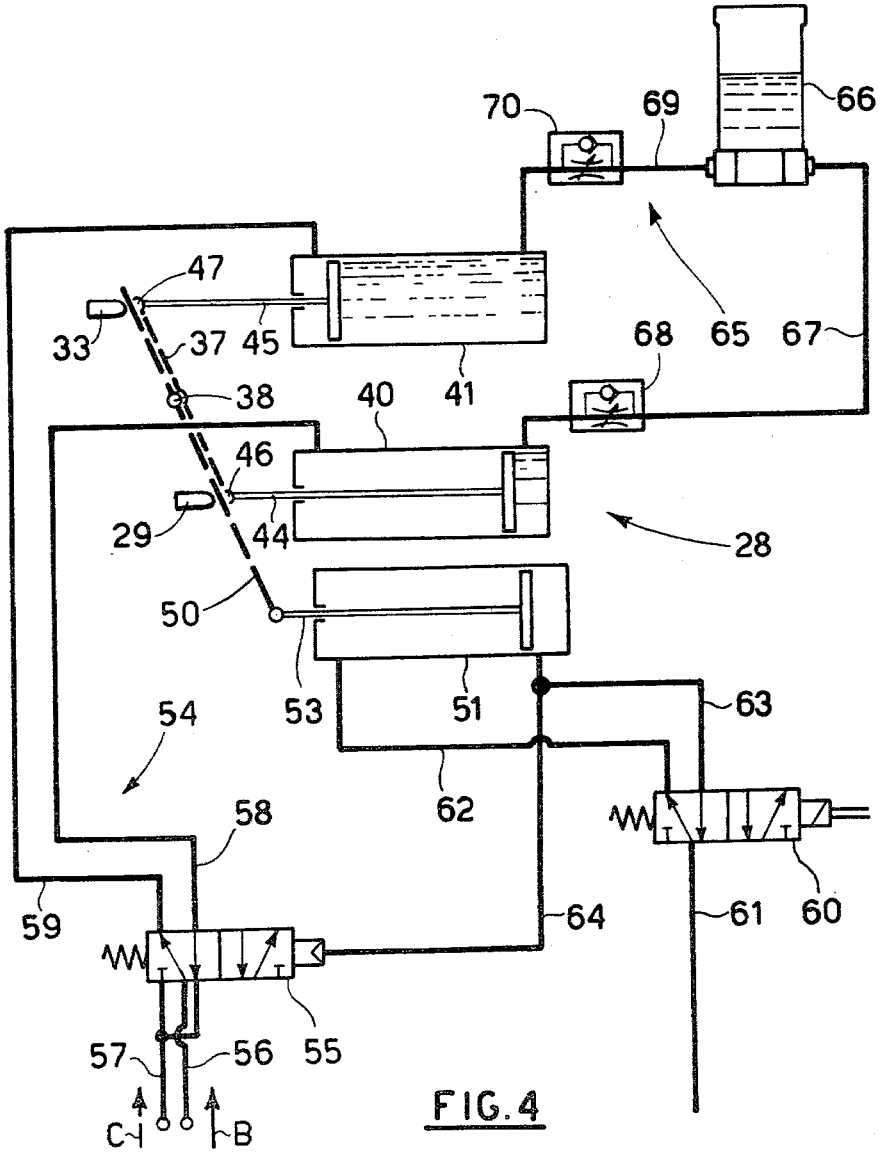
FIG. 4 is a schematic view of the pneumatic control circuit for the device.

A pneumatic cylinder 51 is pivotably connected to a vertical fulcrum 52 mounted on the base plate 10 and by means of its actuating rod 53 it serves to pivot the rocking lever 50 into a preselected position of operative contact with one of the vertical strikers. With reference to FIG. 4, the operating means 28 is also provided with a control circuit for the cylinders which includes a pneumatic circuit 54 for actuating the cylinders 40, 41. This circuit includes a communicating valve 55 operatively connected to two supply conduits 56 and 57 which are connected to any suitable control element (not shown) mounted on the sewing machine and serves as a means for initiating a pneumatic flow into conduit 56 in the direction of arrow B during the stitching cycle and into conduit 57 in the direction of arrow C when the machine is not operating. This flow in conduit 56 displaces a selected limiting element within its respective passage during the stitching cycle and at the completion of the cycle the change of flow into the conduit 57 is effective in causing the return of said selected limiting element to its initial position.

Two conduits 58 and 59 are provided extending from the communicating valve 55 which connect it with the cylinders 40 and 41 so as to alternately direct the above mentioned pneumatic flow to the front of the respective pistons to cause them to withdraw.

A second communicating valve 60 is connected to a suitable source of compressed air by a pneumatic feed 61 and by means of two conduits 62 and 63 said valve is operatively connected to opposite sides of the piston within the cylinder 51.

As shown in FIG. 4 this conduit 63 interconnecting the communicating valve 60 with the cylinder 51 is also connected to the communicating valve 55 by means of a conduit 64 and provides a means for changing both the operating position of said valve 55 and the position of the rocking lever 50 when the seaming operation requires that a change be made so that the other of the two limiting elements is caused to move within its respective passage during the stitching cycle. The operating means 28 also include an oleodynamic circuit 65 operatively connected to the cylinders 40 and 41.

This oleodynamic circuit includes a reservoir 66 which is connected to the rear side of the piston of cylinder 40 by means of a conduit 67 provided with a regulating valve 68 and said reservoir is also connected to the rear side of the piston of cylinder 41 by means of a conduit 69 provided with a regulating valve 70. These valves 68 and 70 are of the volume regulator type such as shown and described in U.S. Pat. No. 4,075,957. These regulating valves 68 and 70 are of a conventional and well known type in which their passageways for the flow of fluid therethrough can be selectively increased or decreased in size whereby the rate of fluid travel from cylinders 40 to 41 and vise-versa can be pre-set so that the actuating rods 42 and 43 respectively of said cylinders will be moved at a speed best suited for the particular types of fabric forming the workpiece.

The oleodynamic circuit 65 is of the closed type and is filled with liquid that serves to regulate the velocity of displacement of the rocking lever 37 about the fulcrum 38 and to regulate the velocity of the associated limiting element with respect to the stitching axis 19.

Figure 5:
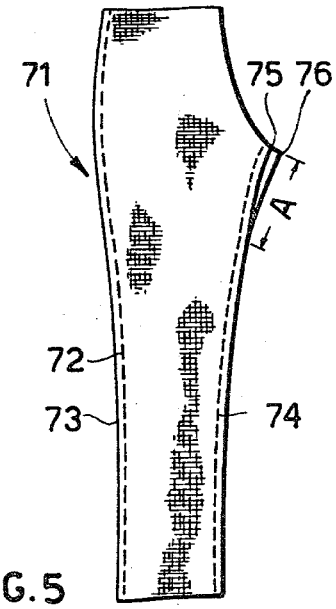
FIG. 5 is a view in side elevation of the leg portion of trousers to be joined by the guiding device of the invention.

With reference to FIG. 5, the example illustrated shows trousers or a leg portion 71 consisting of two layers of superposed fabric which have been joined along one side by a seam 72 extending parallel to the mating edges 73 of said layers. To complete the seaming operation, a seam 74 is incorporated along the opposed sides of the fabric layers which are depicted by numerals 75 and 76 respectively. In the example shown, the lower layer is dimensionally wider in order to be able to enlarge the upper part of the leg portion. At the start of the seam 74 the edge 76 is displaced from edge 75 and the rocking lever 50 is in contact with the vertical striker 33 of the limiting element 14, which prevents any displacement of it from its position with respect to the stitching axis 19.

The other vertical striker 29 is in contact with the end 46 of rocking arm 37 in opposition to the force of the return spring 31 and during the seaming operation cylinder 40 draws its actuating rod 44 inwardly which permits said spring 31 to move the limiting element 11 away from the stitching axis so as to present a deeper passage for accommodating the excess or so-called "fabric richness" of the lower layer of fabric.

Upon completion of the stitching operation the valving arrangement within the pneumatic control circuit (FIG. 4) is effective in causing the flow to move in the direction of arrow B from the conduit 56 thence through the communicating valve 55 and into conduit 59 so as to cause cylinder 41 to draw its actuating rod 45 inwardly or to the right as viewed in FIG. 1*a*. This movement pivots the rocking lever 37 in a clockwise direction and causes the end 46 thereof to engage the striker 29 to effect return of the limiting element 11 to its initial position whereat it is in position for the start of the next seaming operation.

As result of what has been explained above, the vertical striker 29 is gradually withdrawn in a direction away from the stitching axis 19 by the retraction of spring 31 when the end 46 of the rocking arm 37 is pivoted to the right by actuating rod 44 being moved inwardly by its cylinder 42.

During stitching the two layers of fabric are caused to slide within their respective passages 13 and 16 toward the sewing machine and are maintained in contact with the vertical walls 17 and 18 of their respective limiting elements 11 and 14. Because the limiting element 11 is disposed to form a deeper passage 13, the layer of fabric therein is also correspondingly disposed and during the stitching operation, the "fabric richness" becomes gradually reduced due to the displacement of said limiting element 11.

At this stage, the liquid contained in cylinder 41 is forced into reservoir 66 by first passing through the regulating valve 70 which regulates its flow velocity and the velocity of displacement of limiting element 11 is also regulated. This control of velocity, being a function of the operating speed of the machine, determines the length A of the seam 74, for example 30 centimeters, within which the "fabric richness" is totally absorbed and the edges 75 and 76 become aligned one with the other. At this point the rocking arm 37 has reached the position shown in FIG. 1.

Upon completion of the seam 74, the machine stops and within the electric valve mentioned above a switching occurs causing the flow to be directed into conduit 57, in the direction of arrow C, and, via the connecting valve 55 and the conduit 58 it reaches the cylinder 40.

The piston of cylinder 40 now becomes displaced towards the right at a speed which is controlled by the regulating valve 68 and in this way the device is in readiness for the next stitching cycle.

When it is necessary to assemble a leg portion 71 in which the wider layer is the upper layer, it is required that the upper limiting element be the one that is movable. The procedure for prearranging the guiding device for this purpose is that of changing over the position of the rocking lever 50. In order to accomplish this a suitable hand control is provided (not shown) which is operatively connected to the first switching valve 60 which causes it to switch over and direct a flow into conduit 63 and consequently into cylinder 51. In this way the rocking lever 50 reverses its position illustrated in FIG. 4 and at the same time a regulating flow is directed into conduit 64 which causes the switching over of valve 55 as well.

This switching reverses the direction of flow in conduits 58 and 59 which effects the reversal of position of the pistons within the cylinders 40 and 41, and places the guiding device in readiness for the desired stitching cycle.

Figure 6:
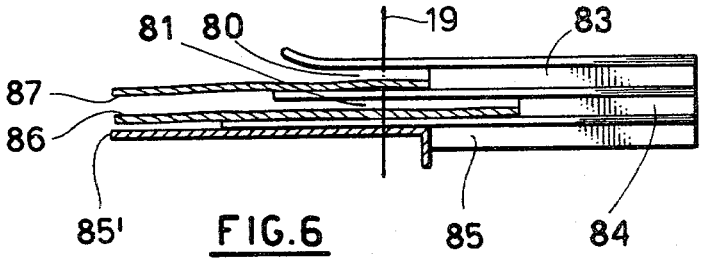
FIGS. 6 and 7 are schematic views of a modification of the guiding device according to the present invention.
Figure 7:
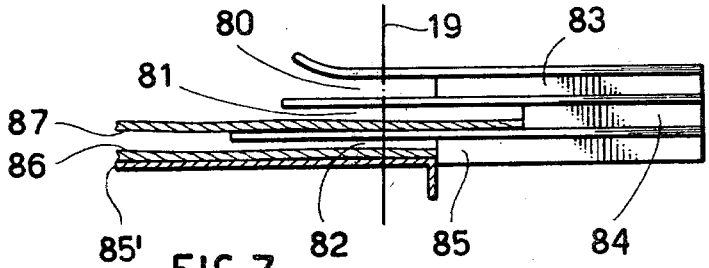

With reference to FIGS. 6 and 7 a modification of the guiding device according to the invention is shown which includes three superposed passages 80, 81 and 82 which are each provided with a limiting element 83, 84 and 85 respectively. In this modification, the limiting elements 83 and 85 are disposed at equal distances from the stitching axis 19.

In this form of guiding device, only the central limiting element 84 is movable within its passage; however, the complete guiding device assembly can be displaced vertically with respect to the plane of stitching 85'. This feature of vertical displacement of the guide assembly permits passage 82 to be selectively located above or below the plane of stitching thereby providing a means in which either the upper or lower layer of fabric can be the displaceable one relative to the stitching axis 19.

In practice, if the wider layer is the lower one 86 with respect to the other layer 87 it is sufficient to lower the guiding device as shown in FIG. 6 to a position where the passage 82 is located below the plane of stitching 85'. If the wider layer is the upper one 87, the guiding device is raised until the passage 82 is located above the plane of stitching 85', and the lower layer of fabric 86 (FIG. 7) is inserted therein.

Figure 8:
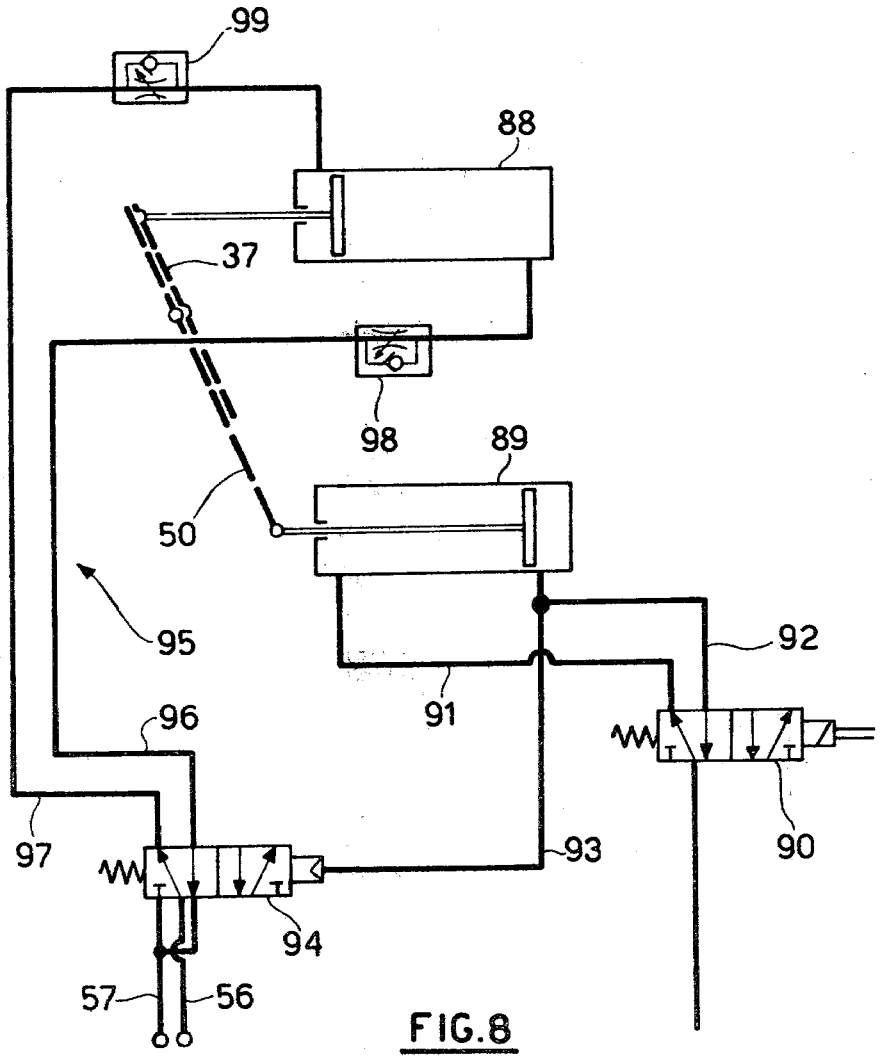
FIG. 8 is a schematic view of a modified pneumatic control circuit for the guiding device.

A modified control circuit shown in FIG. 8 is simplified relative to that shown in FIG. 4 because the rocking arm 37 now only has the function of displacing a single limiting element by means of a single pneumatic cylinder 88. The rocking lever 50, by means of a suitable and simplified kinematic return system (not shown), provides a means for raising or lowering the guiding device and is operatively connected to a pneumatic cylinder 89 corresponding to cylinder 51.

This simplified control circuit further provides a first switching valve 90 for the choice of cycle and is connected by means of conduits 91 and 92 with the cylinder 89 and by means of a conduit 93 with a second switching valve 94 that forms a part of the power circuit 95.

The second switching valve 94 is connected to the conduits 56 and 57 coming from the electric valve of the sewing machine and with the conduits 96 and 97 which are also connected through regulative valves 98 and 99 respectively to the cylinder 88. It should be noted that this circuit functions in a manner which corresponds to the circuit shown in FIG. 4 and it can be effectively substituted for the operation of the guiding device according to FIG. 1.

Although the present invention has been described in connection with a preferred embodiment and a single modification thereof, it is to be understood that other modifications and variations may be resorted to without departing from the spirit and scope of the invention as those skilled in the art will readily understand. Such modifications and variations are considered to be within the purview and scope of the invention and the appended claims.

We claim:

1. An improved workpiece guiding device for independently guiding separate layers of fabric to be joined by seaming to the stitching instrumentalities of a sewing machine in which a portion of one of the layers of fabric has a greater width than that of the other, said guiding device comprising:

(a) superposed passages for independently and simultaneously guiding separate layers of fabric;

(b) a limiting element within each passage for engaging the edges of the layers of fabric to be joined by seaming;

(c) means for moving each of said limiting elements within its respective passage during the seaming cycle in a direction perpendicular to the machine's stitching axis as the separate layers of fabric are advanced by a cloth feed means; and (d) selecting means operatively associated with each of said limiting elements to provide for movement of the limiting element which guides the layer of fabric having the greater width to effect alignment with the edge of the other layer to which it is to be joined.

2. The workpiece guiding device according to claim 1 wherein said limiting elements (11,14) include vertical strikers (29,31) respectively fixed thereto.

3. The workpiece guiding device according to claim 2 wherein said moving means includes:

(a) biasing means (31,35) connected to said vertical strikers (29,31) respectively for continuously urging said limiting elements in a direction away from the stitching axis;

(b) a rocking arm (37) operatively associated with the striker of the movable limiting element; and (c) operating means connected to said rocking arm (37) for effecting gradual displacement of the movable limiting element by said biasing means during the seaming operation to effect alignment of the edges (75,76) of the layers of fabric.

4. The workpiece guiding device according to claim 3 wherein said operating means includes pneumatic cylinders (40, 41, 88) operatively connected to a switching valve (55, 94).

5. The workpiece guiding device according to claim 4 wherein said operating means includes a closed oleodynamic circuit (65) with regulating valves (68,70) operatively interconnecting said circuit to said cylinders (40,41) for regulating the velocity of flow of oleodynamic liquid from one of said cylinders to the other and the velocity of displacement of the moveable limiting element for controlling the length of the seam (A) that joins the edges (75,76) of the layers of fabric.

6. The workpiece guiding device according to claim 3 wherein said selecting means defines a rocking lever (50) for maintaining one of said limiting elements in a fixed position within its respective passage, and control means operatively connected to said rocking lever for effecting a reversal of function of the movable and fixed limiting elements within their respective passages.

7. The workpiece guiding device according to claim 6 wherein said control means defines a pneumatic cylinder (51) operatively connected to a switching valve (60) for selectively changing the holding position of said rocking lever (50) from one of said limiting elements to the other.

* * * * *